US009032637B2

(12) United States Patent
Propp et al.

(10) Patent No.: US 9,032,637 B2
(45) Date of Patent: May 19, 2015

(54) HANGING JIG

(71) Applicants: Adrienne Propp, Jupiter, FL (US); Morris Propp, Jupiter, FL (US)

(72) Inventors: Adrienne Propp, Jupiter, FL (US); Morris Propp, Jupiter, FL (US)

(73) Assignee: Adrienne Propp, Jupiter, FL (US)

( * ) Notice: Subject to any disclaimer, the term of this patent is extended or adjusted under 35 U.S.C. 154(b) by 142 days.

(21) Appl. No.: 13/676,807

(22) Filed: Nov. 14, 2012

(65) Prior Publication Data

US 2013/0118022 A1 May 16, 2013

Related U.S. Application Data

(63) Continuation-in-part of application No. 29/406,421, filed on Nov. 14, 2011, now Pat. No. Des. 679,613.

(60) Provisional application No. 61/559,481, filed on Nov. 14, 2011.

(51) Int. Cl.
*B25H 7/04* (2006.01)

(52) U.S. Cl.
CPC ..... *B25H 7/04* (2013.01)

(58) Field of Classification Search
CPC ..... B25H 7/04
USPC ..... 33/669, 613, 677, 679
See application file for complete search history.

(56) References Cited

U.S. PATENT DOCUMENTS

| | | | | |
|---|---|---|---|---|
| 3,516,165 | A | 6/1970 | Pfeffer | |
| 3,530,591 | A * | 9/1970 | Moffitt | 33/613 |
| 4,220,309 | A * | 9/1980 | Eisen et al. | 248/542 |
| 4,241,510 | A | 12/1980 | Radecki | |
| 4,382,337 | A * | 5/1983 | Bendick | 33/574 |
| 4,443,949 | A * | 4/1984 | Newton | 33/613 |
| 4,455,756 | A * | 6/1984 | Greene | 33/613 |
| 5,103,573 | A * | 4/1992 | Ehling et al. | 33/613 |
| 5,471,760 | A | 12/1995 | Farris | |
| 5,509,213 | A | 4/1996 | Kelly et al. | |
| 5,867,917 | A | 2/1999 | Karon | |
| 6,003,825 | A | 12/1999 | Abernathy, Jr. | |
| 6,026,584 | A | 2/2000 | Wegman | |
| 6,032,378 | A | 3/2000 | Null | |
| 6,421,928 | B1 | 7/2002 | Miller | |
| 6,473,983 | B1 * | 11/2002 | Gier | 33/613 |
| D488,966 | S | 4/2004 | Rimback | |
| 6,739,065 | B2 | 5/2004 | Hofmeister et al. | |
| 6,883,244 | B2 | 4/2005 | Rimback | |
| 6,898,862 | B1 | 5/2005 | Oberst | |
| 6,971,184 | B2 | 12/2005 | Prevost | |
| 7,155,840 | B1 | 1/2007 | Carbonaro | |
| 7,210,243 | B2 * | 5/2007 | Schmidt et al. | 33/613 |
| 7,814,675 | B2 | 10/2010 | Venderley et al. | |
| D679,613 | S * | 4/2013 | Propp et al. | D10/65 |
| 8,739,423 | B1 * | 6/2014 | Cortum et al. | 33/613 |
| 2004/0049936 | A1 * | 3/2004 | Newman | 33/613 |
| 2010/0200723 | A1 | 8/2010 | Schapanski | |

* cited by examiner

*Primary Examiner* — Christopher Fulton
(74) *Attorney, Agent, or Firm* — Duane Morris LLP; J. Rodman Steele, Jr.; Gregory M. Lefkowitz

(57) ABSTRACT

A hanging jig for locating and marking anchor positions for hanging a picture is described. The hanging jig can include a first arm and a second arm in slidable connection to the first arm, and the first and second arms can be oriented perpendicular to one another. The first arm can also include a picture rest extending forward from a top end of the first arm. The second arm can also include first and second moveable marking members extending backward from the second arm and first and second moveable holding members extending forward from the second arm.

19 Claims, 9 Drawing Sheets

HANGING JIG

CROSS-REFERENCE TO RELATED APPLICATIONS

The application claims priority to U.S. Provisional Application No. 61/559,481 filed Nov. 14, 2011, entitled "HANGING JIG", and is a continuation-in-part of U.S. Design patent application Ser. No. 29/406,421 filed Nov. 14, 2011, entitled "HANGING JIG", which are incorporated herein by reference in their entireties.

FIELD OF THE INVENTION

The present invention relates generally to the field of devices to aid in hanging articles, and more particularly to a jig that is useful for hanging pictures or similar articles on a wall.

BACKGROUND

Various hanging devices are known to be useful in the placement, alignment, and/or mounting of articles on walls. Such devices can aid in the locating and marking of positions for anchors on which the article will be hung. While these hanging devices and others of the prior art are useful in some instances, there are still numerous deficiencies and the potential for more useful and more efficient hanging devices.

SUMMARY

A hanging jig is described herein. The hanging jig can include a first arm and a second arm in slidable connection to the first arm. The first and second arms can be oriented perpendicular to one another. The first arm can include a picture rest extending forward from a top end of the first arm. The second arm can include first and second moveable marking members extending backward from the second arm and first and second moveable holding r embers extending forward from the second arm. The second arm can also include a plurality of member positions in eh the first and second marking members and the first and second holding members can be removably fixed.

The hanging jig can also include first and second integrated members with a marking end and a holding end. The marking end of the first integrated member can correspond to the first marking member. The holding end of the first integrated member correspond to the first holding member. The marking end of the second integrated member can correspond to the second marking member. The holding end of the second integrated member can correspond to the second holding member.

The hanging jig can also include a leveler attached to at least one of first arm and the second arm. The leveler can be attached to the picture rest of the first arm.

The first and second arms can be slidably connected with a fastener. The fastener can be moveable between an open position allowing the second arm to slide in relation to the first arm and a closed position in which a position of the second arm in relation to the first arm is fixed.

The first arm of the jig can also include an alignment member extending backward from an upper portion of the first arm. The first arm can also include a channel adapted for receiving at least a portion of the fastener.

The second arm can also include a recess in a center of a front side. The recess can be adapted for receiving at least a portion of the first arm and allowing the second arm to slide in relation to the first arm when the fastener is in the open position.

The slidable connection of the jig can include a removable connection.

Another hanging jig is described herein. The hanging jig can include a first arm and a second arm removably connected to the first arm. The first and second arms can be oriented perpendicular to one another. The first arm can include a picture rest extending forward from a top end of the first arm. The second arm can include first and second moveable marking members extending backward from the second arm and first and second moveable holding members extending forward from the second arm.

The first arm of the jig can also include a plurality of second arm positions in which the second arm can be removably fixed. The second arm of the jig can also include a plurality of holes adapted for receiving the first and second integrated members.

The hanging jig can also include first and second integrated members each having a marking end and a holding end. The marking end of the first integrated member can correspond to the first marking member. The holding end of the first integrated member can correspond to the first holding member. The marking end of the second integrated member can correspond to the second marking member. The holding end of the second integrated member can correspond to the second holding member. The first and second integrated members can include screws, nails, and pins.

A method for locating and marking anchor positions for hanging a picture is also described herein. The method can include a jig with a first arm and a second are in slidable connection to the first arm. The first and second arms can be oriented perpendicular to one another. The first arm can include a picture rest extending forward from a top end of the first arm, and the second arm can include first and second moveable marking members extending backward from the second arm and first and second moveable holding members extending forward from the second arm.

The method can include: providing the jig; placing a front side of the jig against a back side of a picture, with the picture rest abutting a center portion of a top side of the picture; engaging a picture wire disposed on the back side of the picture with the first and second holding members; fixing the second arm to the first arm in a position wherein the picture wire is substantially taut; removing the jig from the picture; aligning a back side of the jig on a surface in a position with the picture rest corresponding to a desired hanging location for the center portion of the top side of the picture; and marking the surface with the first and second marking members.

The method can also include: positioning the first and second marking members on the second arm equidistant from the first arm, with a distance between the first and second marking members at approximately one third of a width of the picture; aligning the first holding member with the first marking member; and aligning the second holding member with the second marking member. The distance between the first and second marking members is can include one third of the width of the picture frame rounded up to the nearest even number or one third of the width of the picture frame rounded down to the nearest even number.

In placing a front side of the jig against a back side of a picture, the method can also include: placing a front side of the jig against a back side of a picture, with the picture rest abutting a center portion of a top side of the picture. In aligning a back side of the jig on a surface, the method can also include aligning a back side of the jig on a surface in a position wherein the picture rest corresponds to a desired hanging location for the center portion of the top side of the picture.

The jig can also include an alignment member extending backward from an upper portion of the first arm and a leveler attached to at least one of the first arm and the second arm. In aligning the jig on the surface, the method can also include: positioning the alignment member on the surface at a point below the top center of the desired hanging location; and leveling the jig.

These and other features, objects and advantages of the present invention will become more apparent to one skilled in the art from the following description and claims when read in light of the accompanying drawings.

DETAILED DESCRIPTION

Figure 1:
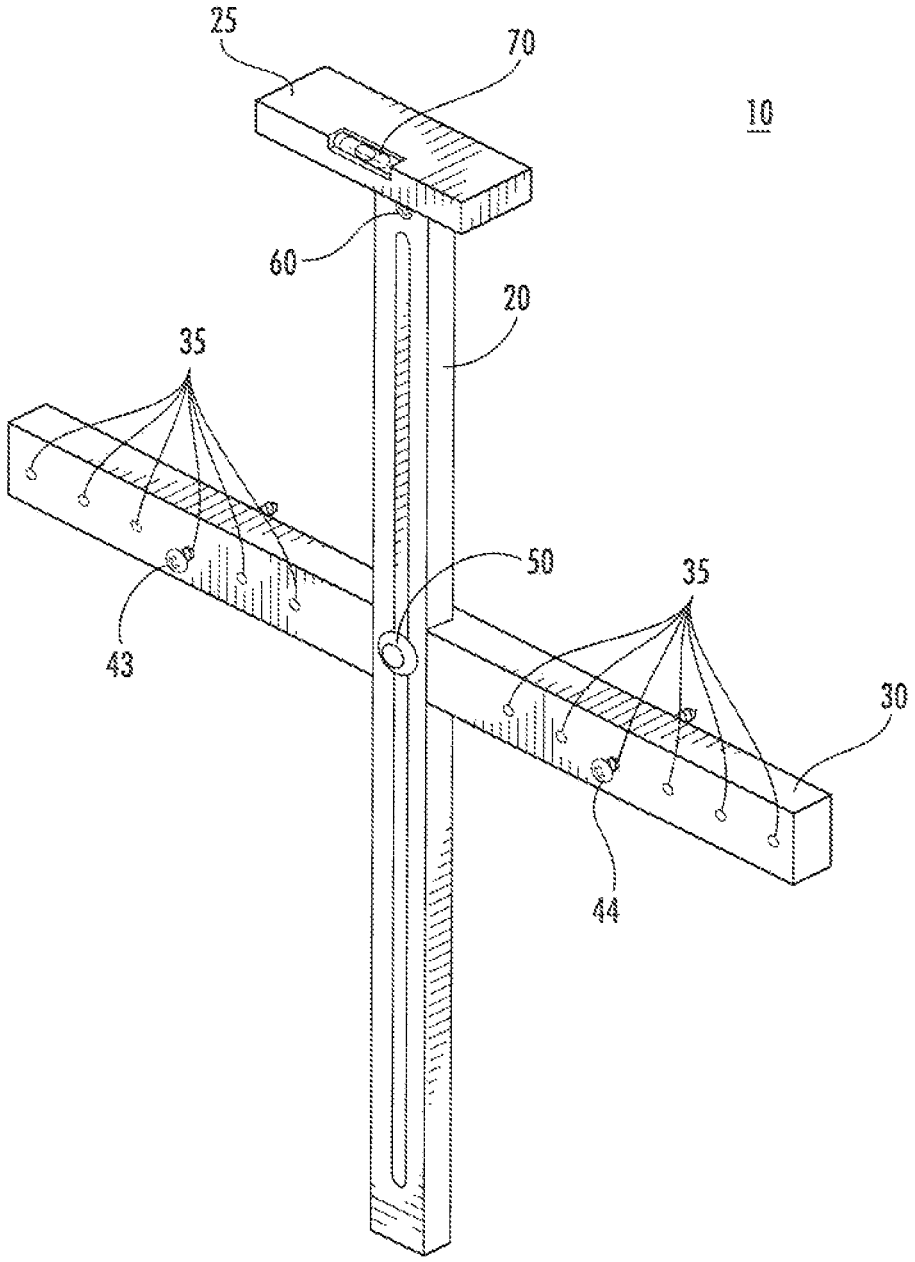
FIG. 1 is a perspective view of an embodiment of the hanging jig described herein, in an assembled position.

The terminology used herein is for the purpose of describing particular embodiments only and is not intended to be limiting of the invention. As used herein, the singular forms "a", "an" and "the" are intended to include the plural forms as well, unless the context clearly indicates otherwise. Furthermore, to the extent that the terms "including", "includes", "having", "has", "with", or variants thereof are used in either the detailed description and/or the claims, such terms are intended to be inclusive in a manner similar to the term "comprising."

The term "approximately" means within an acceptable error range for the particular value as determined by one of ordinary skin in the art, which will depend in part on how the value is measured or determined, i.e., the limitations of the measurement system. For example, "approximately" can mean a range of up to 20%, preferably up to 10%, more preferably up to 5%, and more preferably still up to 1% of a given value. Where particular values are described in the application and claims, unless otherwise stated the term "approximately" means within an acceptable error range for the particular value should be assumed.

As used herein the terms "picture" and "pictures" can include pictures, picture frames, mirrors, and other decorations typically hung or otherwise displayed on a wall. The terms "picture" and "pictures" can also include any suitable article to be hung on a surface. Pictures can be hung in a variety of ways, including various types of hardware. One way can include the use of a length of picture wire or similar mounting structure attached to a back side of a picture. The picture can be hung by securing the picture wire over anchors, such as hooks, nails, screws and the like, attached to a wall or other surface. For more stable mounting, two or more anchors can be attached to the wall.

As best shown in FIGS. 1-7, a hanging jig 10 for locating and marking anchor positions for hanging a picture is described. The hanging jig 10 can include a first arm 20 and a second arm 30 in connection to the first arm 20, and the first and second arms 20, 30 can be oriented perpendicular to one another. The first arm 20 can include a picture rest 25 extending forward from a top end of the first arm 20. The second arm 30 can include first and second moveable marking members 41, 42 extending backward from the second arm 30 and first and second moveable holding members 43, 44 extending forward from the second arm 30.

Figure 2:
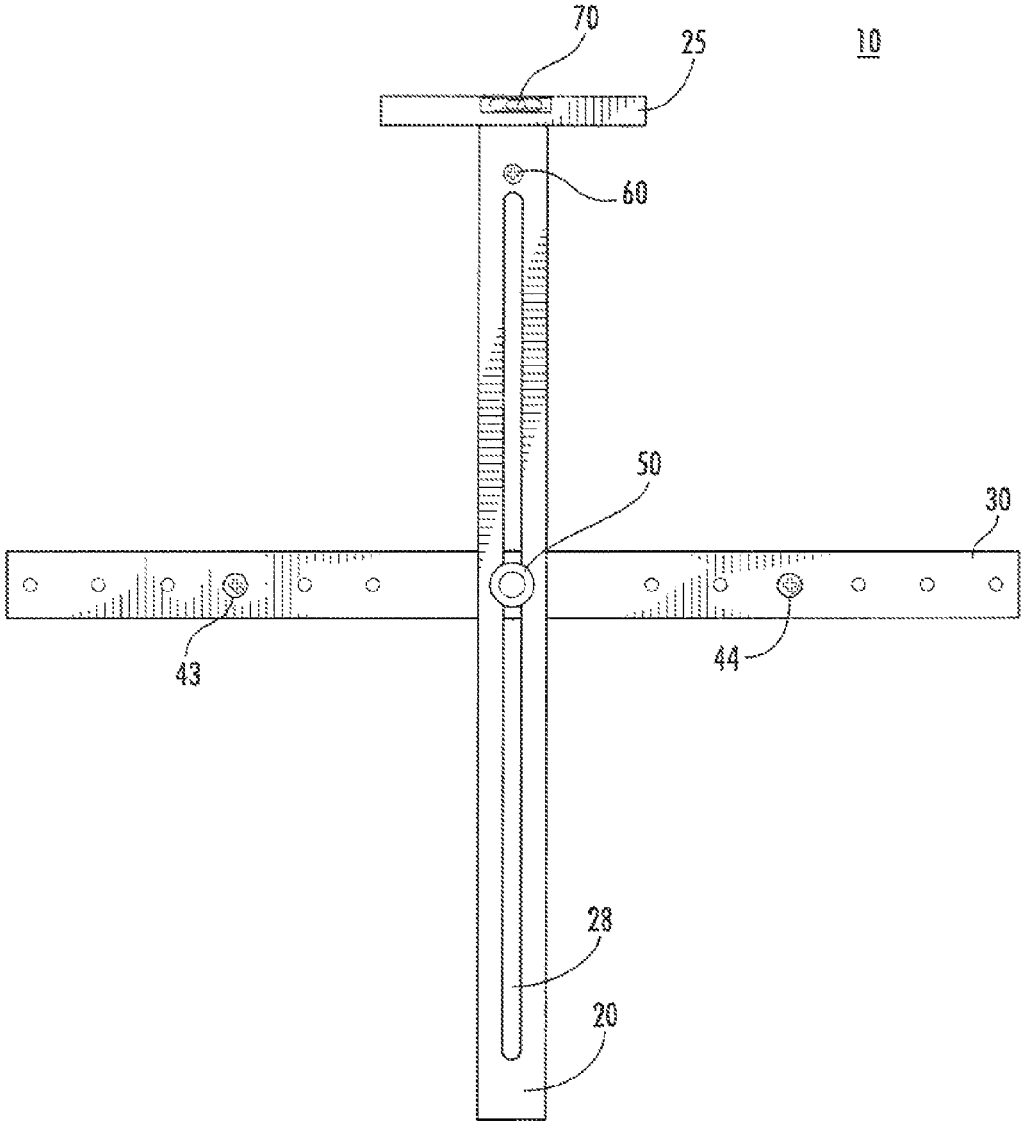
FIG. 2 is a front view of an embodiment of the hanging jig described herein.
Figure 3:
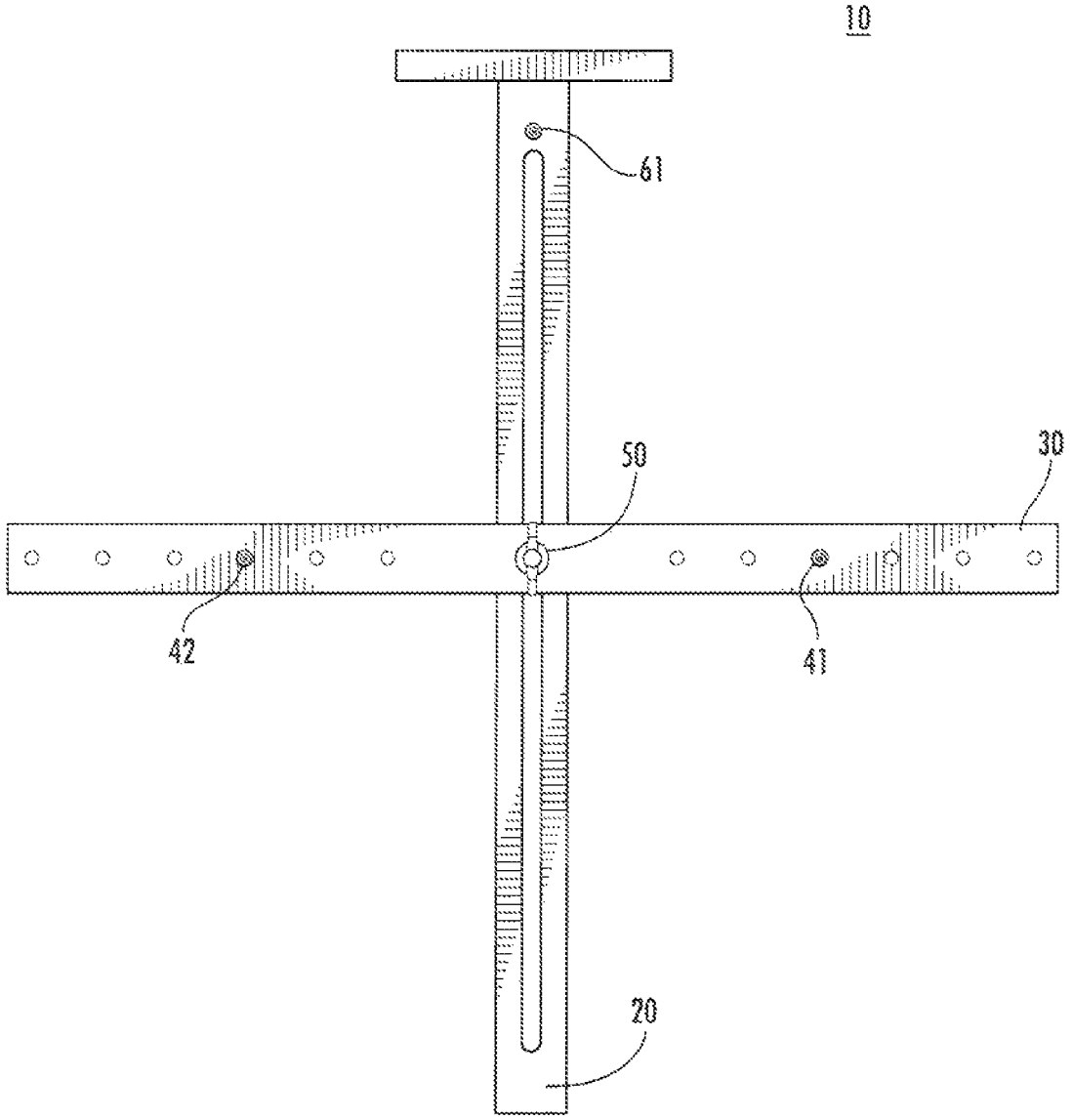
FIG. 3 is a back view of an embodiment of the hanging jig described herein.

As used herein, the terms "forward" and "backward" with respect to the first and second arms refer to extending outward from a front side and back side, respectively, of the arm. As used herein, the terms "front" and "back" with respect to the jig refer to sides depicted in FIGS. 2 and 3, respectively. Other terms of orientation, including "left," "right," "top," "bottom," "vertical" and "horizontal," with respect to the jig refer to the sides, ends or direction of the jig when a user is facing the front side such as depicted in FIG. 2.

As used herein, the terms "perpendicular," "center," and "equidistant" are intended to include minor deviations from the position defined herein. For example, deviations of plus or minus 15 degrees, or plus or minus 10 degrees, or plus or minus 5 degrees or deviations of plus or minus 0.5 inch, or plus or minus 1 inch, or plus or minus 5 inches, as applicable.

In one exemplary arrangement, the first and second arms 20, 30 can be oriented perpendicular to one another with the first arm 20 substantially vertical and the second arm 30 substantially horizontal. The position of the second arm 30 along the first arm 20 can be selectively fixed.

Figure 8A:
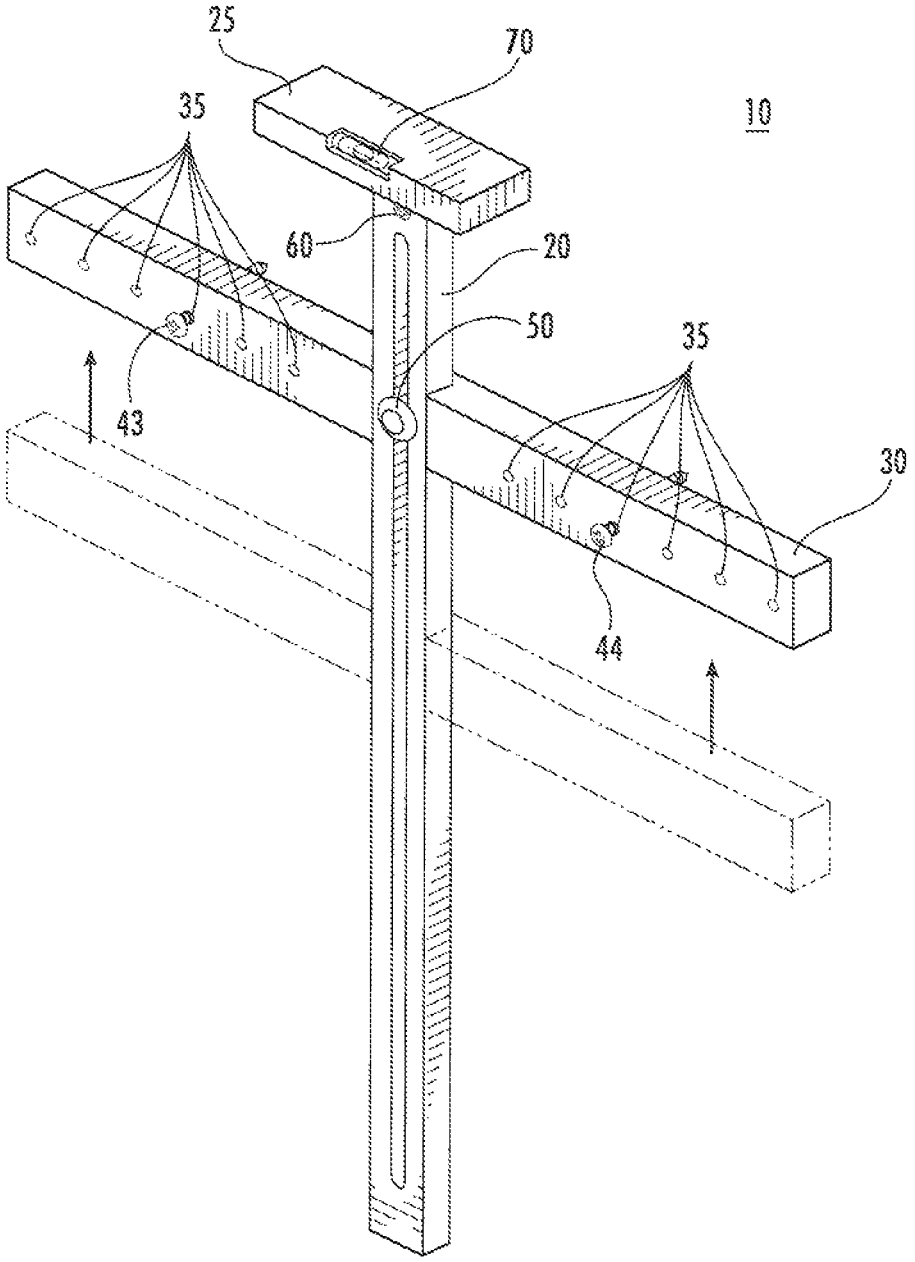
FIG. 8A is a perspective view of an embodiment of the hanging jig described herein, showing a slidable connection of the arms.
Figure 8B:
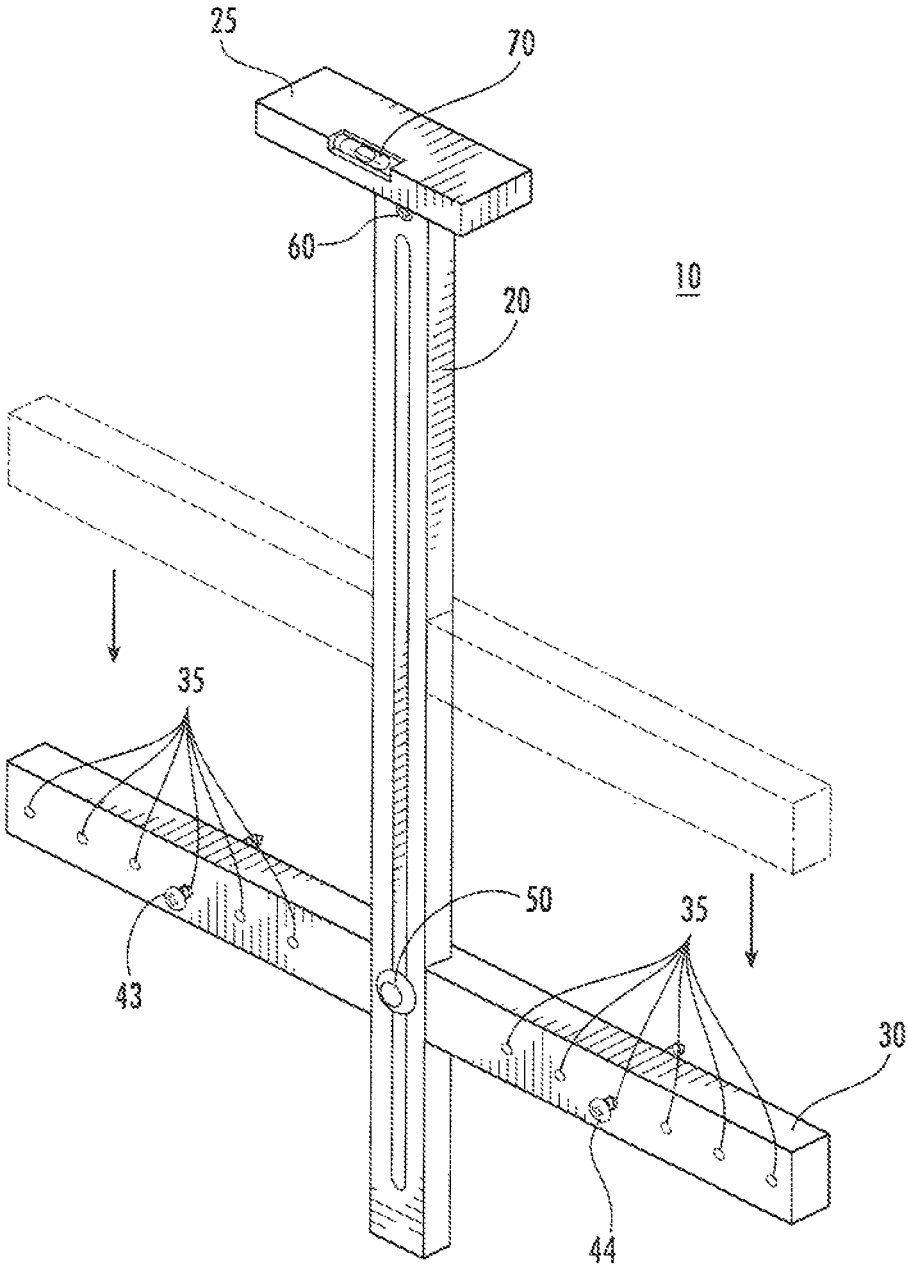
FIG. 8B is another perspective view of an embodiment of the hanging jig described herein showing a slidable connection of the arms.

In one embodiment, the second arm 30 can be slidably connected to the first arm 20 such that the second arm 30 can slide along at least a portion of the length of the first arm 20. In another embodiment, the second arm 30 can be removably connected to the first arm 20 in another embodiment as shown in FIGS. 8A and 8B, the second arm 30 can be slidably and removably connected to the first arm 20. The first arm 20 can also include a plurality of second arm positions in which the second 30 can be removably fixed. For example, the second arm 30 can be removably fixed to the first arm 20 in a position as shown in FIG. 8A or removably fixed in a position as shown in FIG. 8B.

In an exemplary arrangement, the first arm 20 and the second arm 30 can be connected with a fastener 50, with the fastener 50 moveable between an open position allowing the second am 30 to slide in relation to the first arm 20 and a closed position in which a position of the second arm 30 in relation to the first arm 20 is fixed. The fastener 50 can include any suitable fastened elements such as bolts, nuts, wingnuts, screws, rivets, pins, clamps, clips, hooks and combinations thereof.

Figure 4:
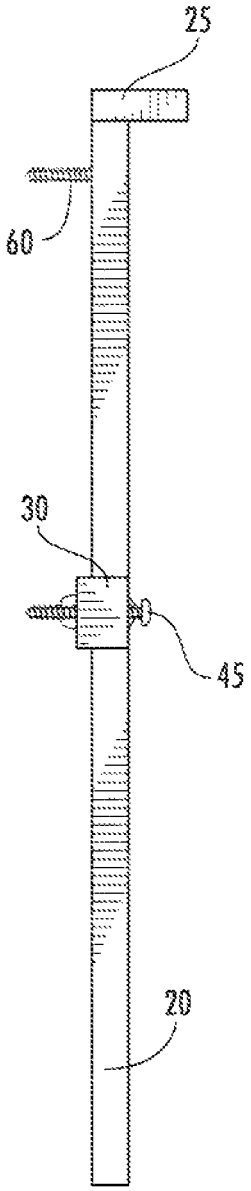
FIG. 4 is a side view of an embodiment of the hanging jig described herein.
Figure 5:
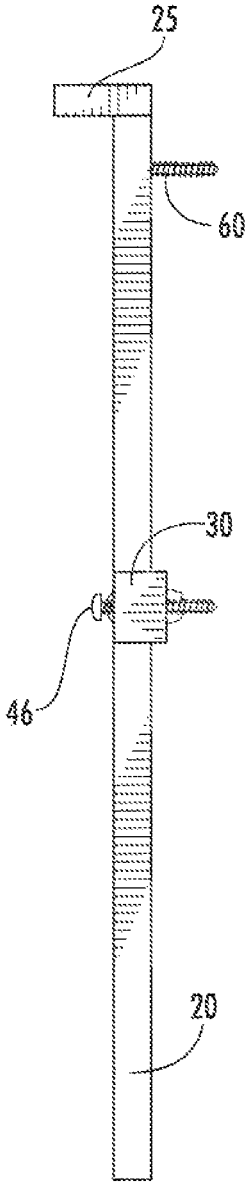
FIG. 5 is another side view of an embodiment of the hanging jig described herein.

As shown in FIG. 2, the first arm 20 can also include a channel 28 adapted for receiving at least a portion of the fastener 50. The second arm 30 can also include an opening adapted for receiving at least a portion of the fastener 50. The second arm 30 can also include a recess in a center of a front side of the second arm 30 as shown in FIG. 1. The recess can be adapted for receiving at least a portion of the first arm 20 and allowing the second arm 30 to slide in elation to the first arm 20 when the fastener 50 is in the open position. The recess can also be adapted such that the front side of the first arm 20 lies substantially flush the front side of the second arm 30 when the arms are connected perpendicular to one another, as shown in FIGS. 1, 4 and 5. A middle portion of the fastener 50 can be received through the channel 28 of the first arm 20 and through an opening through the center of the second arm 30 to slidably and removably connect the arms 20, 30.

The second arm 30 of the jig 10 includes first and second moveable marking members 41, 42 extending backward from the second arm 30. The marking members 41, 42 are configured to provide a marking on a surface when placed against the surface. The markings can be created by writings, impressions, punctures, or any other suitable marks. For example, the marking members 41, 42 can include without limitation pointed or sharp objects such as the sharp end of screws, nails and pins and/or can include materials capable of providing permanent or erasable marks such as lead, graphite, charcoal, ink, wax and chalk. The first and second marking members 41, 42 can protrude from the back side of the jig 10 further than the fastener 50. The first and second marking members 41, 42 can also protrude from the back side of the jig 10 at substantially the same distance.

The second arm 30 of the jig 10 also includes first and second moveable holding members 43, 44 extending forward from the second arm 30. The holding members 43, 44 are configured to removably engage with a length of picture wire or similar handling mechanism. For example, the holding members 43, 44 can include any suitable form including without limitation hooks, heads of screws and nails, and notches. The first and second holding members 43, 44 can protrude from the front side of the jig 10 at least as far out or further than the fastener 50.

Figure 6:
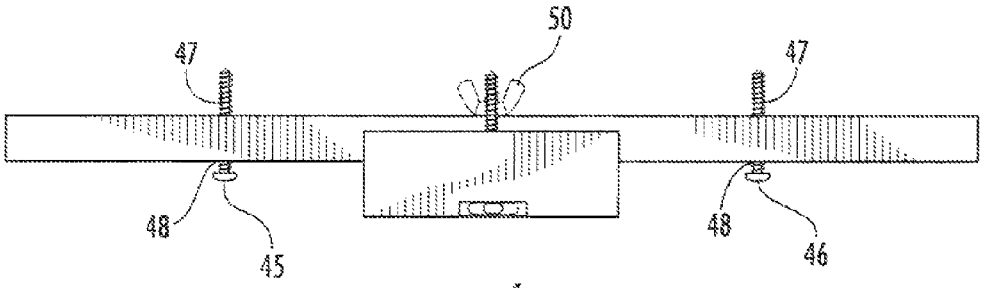
FIG. 6 is a top view of an embodiment of the hanging jig described herein.
Figure 7:
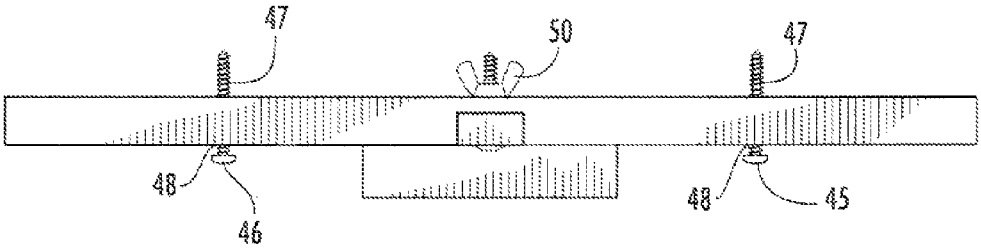
FIG. 7 is a bottom view of an embodiment of the hanging jig described herein.

The holding members 43, 44 and marking members 41,42 can be separate or integrated. In an exemplary arrangement, the marking and holding members 41, 42 & 43, 44 can be integrated in first and second integrated members 45, 46, each having a marking end 47 and a holding end 48. The marking end 47 of the first integrated member 45 can correspond to the first marking member 41 and the holding end 48 of the first integrated member 45 can correspond to the first holding member 43. Similarly, the marking end 47 of the second integrated member 46 can correspond to the second marking member 42 and the holding end 48 of the second integrated member 46 can correspond to the second holding member 44. For example as shown in FIGS. 6 and 7, the integrated members 45, 46 can include a screw or similar mechanism, with the marking end 47 comprising the sharp end and the holding end 48 comprising the head.

The second arm 30 can also include a plurality of member positions 35 in which the first and second marking members 41, 42 and the first and second holding members 43, 44 (or the first and second integrated members 45, 46) can be removably fixed. The plurality of member positions 35 can also include a plurality of holes 35. In arrangements wherein the marking members 41, 42 and holding members 43, 44 are integrated, the plurality of holes 35 can be adapted for receiving the first and second integrated members 45, 46. The plurality of holes 35 can also be threaded, for example in embodiments in which the integrated members 45, 46 include screws or other members with corresponding threading. The plurality of member positions 35 can be spaced apart along the length of the second arm 30. For example, the member positions 35 can be located approximately 0.25 inch apart, or approximately 0.5 inch apart, or approximately 1 inch apart, approximately 1.25 inches apart, or approximately 2 inches apart.

Figure 10:
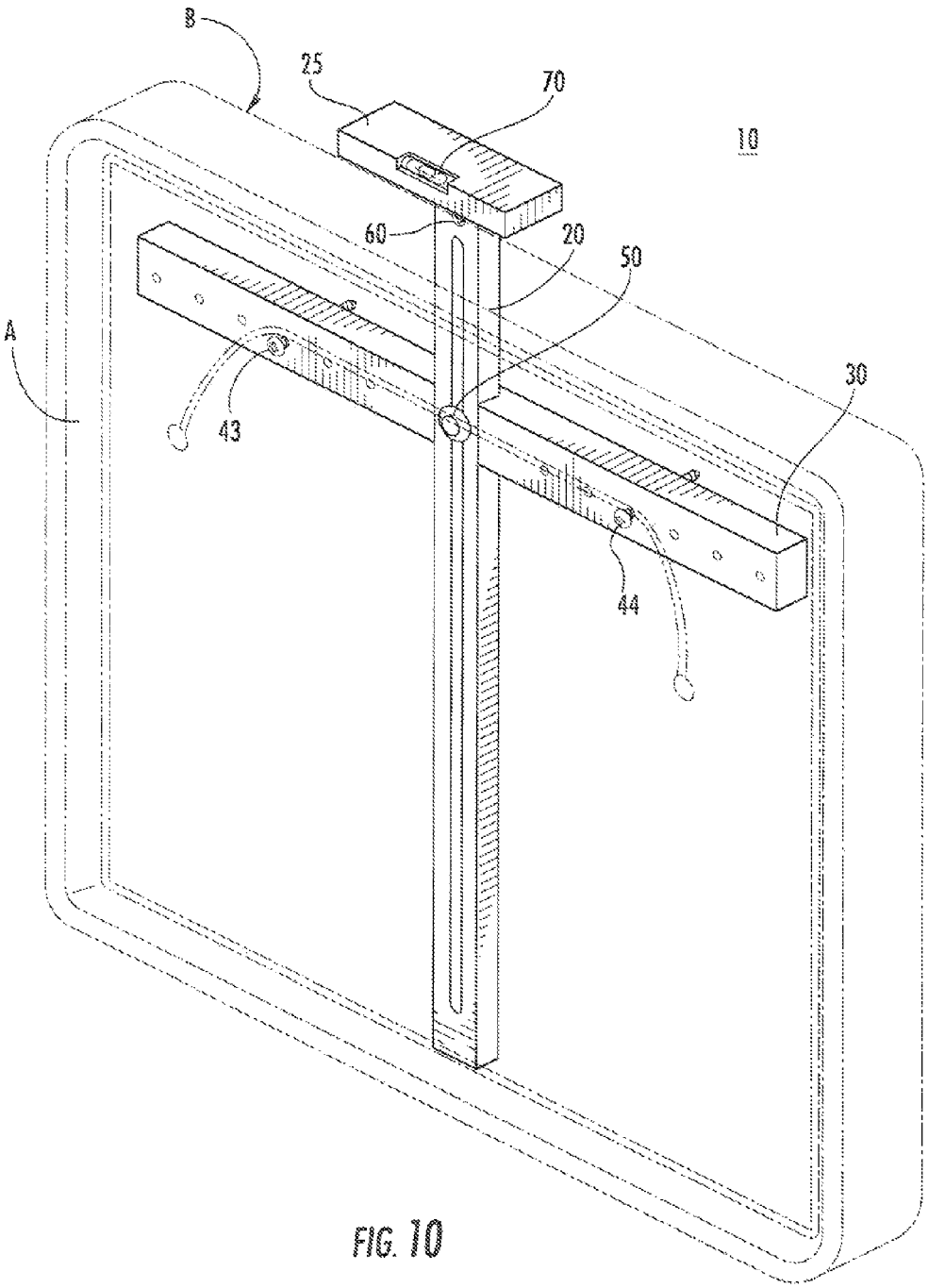
FIG. 10 is a perspective view of an embodiment of the hanging jig described herein, against a back side of a picture.

The first arm 20 of the jig 10 can include a picture rest 25 extending forward from a top end of the first arm 20. In an exemplary arrangement, the picture rest 25 can be configured such that at least a portion of a bottom side of the picture rest 25 can abut an edge of a picture A when the front side of the vertical arm 20 of the jig 10 is positioned against a back side B of the picture A, for example as shown in FIG. 10.

As shown in FIGS. 4 and 5, the first arm 20 can also include an alignment member 60 extending backward from an upper portion of the first arm 20. The alignment member 60 can also extend from a position proximate to the top end of the first arm 20. The alignment member 60 can also extend from a position on an upper portion of the first arm 20 and below the picture rest 26. For example, the alignment member 60 can be approximately 0.1 inch below the picture rest 25, or approximately 0.5 inch below the picture rest 25, approximately 1 inch below the picture rest 25, or approximately 1.5 inches below the picture rest 25, or approximately 2 inches below the picture rest 25. The alignment member 60 can also protrude from the back side of the jig 10 at least as far out as or further than the first and second marking members 41, 42. The alignment member 60 can be adapted to identify and/or assist in holding the jig 10 in a position on a surface in which alignment of the jig 10 can be performed. The alignment member 60 can also include a marking end 61 that extends from the back of the vertical arm 20.

The hanging jig 10 can also include a leveler 0 attached to at least one of the first arm 20 and the second arm 30. For example, the leveler 70 can be attached to the picture rest 25 of the first arm 20 and/or the leveler 70 can be embedded in a front side of the picture rest 25. The leveler 70 can include any suitable mechanism for measuring true horizontal or relative heights, such as a spirit or bubble level or a laser level.

The first and second arms 20 30 can include any suitable material including without limitation metal such as bronze, steel, and aluminum; plastics such as starboard lumber and polyvinyl chloride; wood; and other composite materials.

Figure 9:
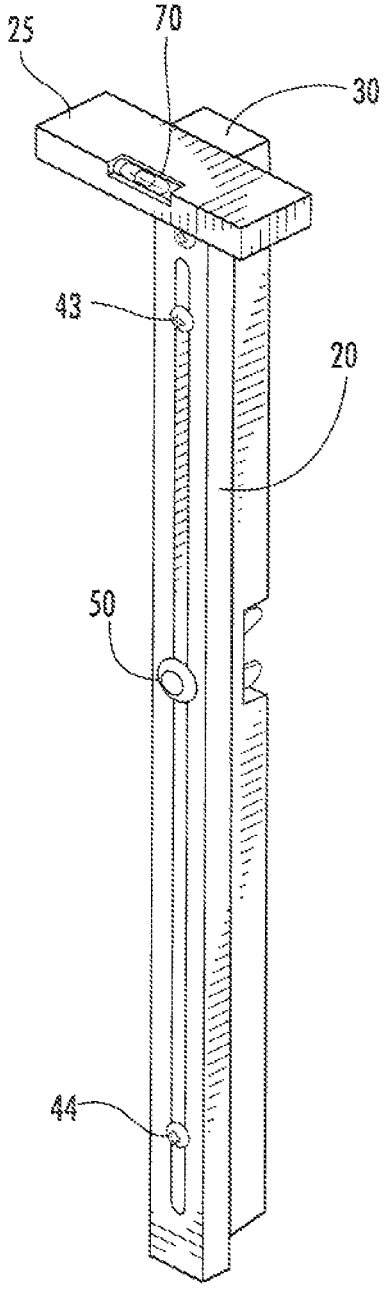
FIG. 9 is a perspective view of an embodiment of the hanging jig described herein, in a stored position.

The length of the first and second arms 20, 30 can be any suitable length and can vary depending on the size of the picture to be hung. For example, the second arm 30 can be approximately 0.5 to 3 feet long, or approximately 1 to 2 feet long, or approximately 1 to 5 feet long. The length of the first arm 20 can also be approximately the same length as the second arm 30 or it can be shorter or longer than the second arm, In another embodiment the jig 10 can include an assembled position and a stored position. In the assembled position, the first and second arms 20, 33 of the jig 10 can be oriented perpendicular to each other as show in FIG. 1. In the stored position, the first and second arms 20, 30 can be oriented parallel to each other. In one exemplary arrangement as shown in FIG. 9, the first and second arms 20, 30 can be approximately the same length and the second arm 30 can be removably secured to a back side of the first arm 20 in the stored position as shown in FIG. 9. The fastener 50 and/or the marking members 41, 42, holding members, 43, 44 or integrated members 45,46 can be used to removably secure the first and second arms 20, 30 together. The stored position allows a user to easily and efficiently store, carry and transport the hanging jig 10.

A method for locating and marking anchor positions for hanging a picture A is also described herein. The method can include providing a jig 10 as embodied herein; placing a front side of the jig 10 against a back side B of a picture A such that the picture rest 25 abuts a top side of the picture A; engaging a picture wire disposed on the back side of the picture A with the first and second holding members 43, 44; fixing the second arm 30 to the first arm 20 in a position such that the picture wire is substantially taut: removing the jig 10 from the picture A; aligning a back side of the jig 10 on a surface in a position corresponding to a desired hanging location for the picture A; and marking the surface with the first and second marking members 41, 42.

The method can also include positioning the first and second marking members 41, 42 on the second arm 30; aligning the first holding member 43 with the first marking member 41; and aligning the second holding member 44 with the second marking member 42. The first and second marking members 41, 42 can be positioned on the second arm 30 equidistant from the first arm 20, in arrangements of the jig 10 including integrated members 45, 46, the method can also include positioning the first and second integrated members 45, 46 on the second arm 30. The first and second integrated members 45, 46 can be positioned on the second arm 30 equidistant from the first arm 20.

The plurality of member positions 5 on the second arm 30 of the jig 10 can also assist a user in placement of the anchors a suitable distance apart. For example, if the member positions 35 are spaced evenly, such as 1 inch apart, a user can utilize the positions of the member positions to determine the distance between the first and second marking members 41 42, or to position the first and second marking members 41 42 equidistant from the first arm 20, e.g. by counting the number of member positions 35.

A distance between the first and second marking members 41, 42 can be approximately one third of a width of the picture. The distance between the first and second marking members 41, 42 can also be third of the width of the picture rounded up to the nearest even number or one third of the width of the picture rounded down to the nearest even number.

In embodiments of the jig 10 including an alignment member 60 the step of aligning the jig 10 on the surface can also include positioning the alignment member 60 on the surface at a point below the top center of the desired hanging location; and leveling the jig 10. In embodiments of the jig including a leveler 70, such mechanism can assist in the step of leveling the jig.

When aligning a back side of the jig 10 on a surface in a position corresponding to a desired hanging location for the picture, any suitable method can be applied. For example, the step of placing a front side of the jig 10 against a back side B of a picture A can also include the picture rest 25 abutting a center portion of a top side of the picture; and aligning a back side of the jig 10 on a surface can include positioning the jig 10 such that the picture rest 25 can correspond to a desired hanging location for the center portion of the top side of said picture A.

The alignment member 60 can also assist in determining this position. For example, the alignment member 60 can be positioned on the first arm 20 at a known distance below the picture rest 25. The step of aligning a back side of the jig 10 on a surface can also include positioning the jig 10 such that the alignment member 60 can identify, hold or mark a position corresponding to the horizontal center and the known distance below the top side of the picture.

In an exemplary arrangement, a user can measure the width of a picture frame intended to be hung and calculate the "anchor spacing," i.e. how far apart the anchors should be spaced from each other based on the width of the picture, for example approximately one third of the width of the picture frame. The user can also position the first and second marking members 41, 42 and first and second holding members 43, 44 in the member positions 35 along the second arm 30 corresponding the calculated anchor spacing, and the first marking member 41 (along with the corresponding first holding member 43) and the second marking member 42 (along with the corresponding second holding member 44) can be equidistant from the first arm 20.

The user can also piece the picture rest 25 along the top side of the picture, such that the first arm 20 can rest along a vertical center of the picture and engage the picture wire with the first and second holding members 43, 44, such as by securing the wire over each holding member 43, 44. The user can also move the second arm 30 along the first arm 20 until the picture wire is substantially taut and fix the second arm 30 to the first arm 20 in such a position. The user can then remove the jig 10 from the picture, including removing the picture rest 25 from the top side of the picture.

After removal from the picture, the user can also align a back side of the jig 10 on a wall in a position corresponding to a desired hanging location for the picture, including by inserting the alignment member 60 into the wall at a point that is the known distance below the top center of the desired hanging location; use the leveler 70 to horizontally level the jig 10; and mark the wall with the first and second marking members 41, 42, including by applying pressure to the jig 10 such that the first and second marking members 41, 42 create impressions in the wall. The user can also remove the jig 10 from the wall, and attach anchors at the marks from the first and second marking members 41, 42.

The user can then hang the picture by securing the picture wire to the anchors attached to the wall.

The hanging jig 10 embodied herein provides an adaptable and expedient device to locating and marking positions to picture anchors. Additionally, the jig configuration can be lightweight and portable and is adapted for quick assembly when needed. Therefore, the hanging jig and method provide a more efficient and user-friendly aid in hanging pictures of all types and sizes.

The foregoing is provided for purposes of illustrating, explaining, and describing embodiments of this invention. Modifications and adaptations to these embodiments will be apparent to those skilled in the art and may be made without departing the scope or spirit of this invention.

What is claimed is:

1. A hanging jig, comprising:

a first arm and a second arm in slidable connection to said first arm, wherein said first and second arms are oriented perpendicular to one another; and said first arm comprises a picture rest extending forward from a top end of said first arm;

said second arm comprises first and second moveable marking members extending backward from said second arm and first and second moveable holding members extending forward from said second arm, wherein said second arm further comprises a plurality of member positions on each side of the first arm, wherein said first and second marking members and said first and second holding members can be removably fixed in said plurality of member positions on each side of the first arm.

2. The hanging jig of claim 1, further comprising first and second integrated members each having a marking end and a holding end;

wherein said marking end of said first integrated member comprises said first marking member, said holding end of said first integrated member comprises said first holding member, said marking end of said second integrated member comprises said second marking member, and said holding end of said second integrated member comprises said second holding member.

3. The hanging jig of claim 1, wherein said first arm further comprises an alignment member extending backward from an upper portion of said first arm.

4. The hanging jig of claim 1, further comprising a leveler attached to at least one of said first arm and said second arm.

5. The hanging jig of claim 1, further comprising a leveler attached to said picture rest of said first arm.

6. The hanging jig of claim 1, wherein said first arm and said second arm are slidably connected with a fastener, said fastener being moveable between an open position allowing said second arm to slide in relation to said first arm and a closed position in which a position of said second arm in relation to said first aim is fixed.

7. The hanging jig of claim 6, wherein said first aim further comprises a channel adapted for receiving at least a portion of said fastener.

8. The hanging jig of claim 7, wherein said second arm further comprises a recess in a center of a front side, said recess adapted for receiving at least a portion of said first arm and allowing said second arm to slide in relation to said first arm when said fastener is in said open position.

9. The hanging jig of claim 1, wherein said slidable connection comprises a removable connection.

10. A hanging jig, comprising:

a first arm and a second arm removably connected to said first arm, wherein said first and second arms are oriented perpendicular to one another; and said first arm comprises a picture rest extending forward from a top end of said first arm;

said second arm comprises first and second moveable marking members extending backward from said second arm and first and second moveable holding members extending forward from said second arm, wherein said second arm further comprises a plurality of member positions on each side of the first arm. wherein said first and second marking members and said first and second holding members can be removably fixed in said plurality of member positions on each side of the first arm.

11. The hanging jig of claim 10, wherein said first arm further comprises a plurality of second arm positions wherein said second arm can be removably fixed.

12. The hanging jig of claim 10, further comprising first and second integrated members each having a marking end and a holding end;

wherein said marking end of said first integrated member comprises said first marking member, said holding end of said first integrated member comprises said first holding member, said marking end of said second integrated member comprises said second marking member, and said holding end of said second integrated member comprises said second holding member.

13. The hanging jig of claim 12, wherein said second arm further comprises a plurality of holes adapted for receiving said first and second integrated members.

14. The hanging jig of claim 12, wherein said first and second integrated members are selected from a group consisting of screws, nails, and pins.

15. A method for locating and marking anchor positions for hanging a picture, comprising the steps of:

providing a jig comprising:

a first arm and a second arm in slidable connection to said first arm, wherein said first and second arms are oriented perpendicular to one another, and said first arm comprises a picture rest extending forward from a top end of said first arm, and said second arm comprises first and second moveable marking members extending backward from said second arm and first and second moveable holding members extending forward from said second arm, wherein said second arm further comprises a plurality of member positions on each side of the first arm, wherein said first and second marking members and said first and second holding members can be removably fixed in said plurality of member positions on each side of the first arm;

placing a front side of said jig against a back side of a picture, wherein said picture rest abuts a center portion of a top side of said picture;

engaging a picture wire disposed on said back side of said picture with said first and second holding members;

fixing said second arm to said first arm in a position wherein said picture wire is substantially taut;

removing said jig from said picture;

aligning a back side of said jig on a surface in a position wherein said picture rest corresponds to a desired hanging location for said center portion of said top side of said picture; and marking said surface with said first and second marking members.

16. The method of claim 15, further comprising the steps of:

positioning said first and second marking members on said second arm equidistant from said first arm, wherein a distance between said first and second marking members is approximately one third of a width of said picture;

aligning said first holding member with said first marking member; and aligning said second holding member with said second marking member.

17. The method of claim 16, wherein said distance between said first and second marking members is selected from the group consisting of one third of said width of said picture frame rounded up to the nearest even number and one third of said width of said picture frame rounded down to the nearest even number.

18. The method of claim 15, wherein placing a front side of said jig against a back side of a picture further comprises placing a front side of said jig against a back side of a picture, wherein said picture rest abuts a center portion of a top side of said picture; and aligning a back side of said jig on a surface further comprises aligning a back side of said jig on a surface in a position wherein said picture rest corresponds to a desired hanging location for said center portion of said top side of said picture.

19. The method of claim 15, wherein said jig further comprises an alignment member extending backward from an upper portion of said first arm and a leveler attached to at least one of said first arm and said second arm; wherein the step of aligning said jig on said surface further comprises:

positioning said alignment member on said surface at a point below the top center of the desired hanging location; and leveling said jig.

* * * * *